United States Patent [19]

Ruark

[11] Patent Number: 4,872,443

[45] Date of Patent: Oct. 10, 1989

[54] WATER HEATER WITH POWER VENT ACCESS DOOR

[75] Inventor: Darryl L. Ruark, Lugoff, S.C.

[73] Assignee: A. O. Smith Corporation, Milwaukee, Wis.

[21] Appl. No.: 322,686

[22] Filed: Mar. 13, 1989

[51] Int. Cl.[4] ..... F24H 1/00

[52] U.S. Cl. ..... 126/361; 126/350 R; 49/463; 122/13 R; 122/14; 220/305

[58] Field of Search ..... 126/361, 368, 369, 350 R, 126/367, 344, 362; 122/13 R, 14; 49/463, 465, 466, 40; 220/305

[56] References Cited

U.S. PATENT DOCUMENTS

| | | | |
|---|---|---|---|
| 2,698,007 | 12/1954 | Tegler | 122/13 R |
| 4,303,042 | 12/1981 | Sumiyoshi | 122/13 R |
| 4,669,448 | 6/1987 | West | 126/361 |
| 4,777,933 | 10/1988 | Ruark | 126/361 |

FOREIGN PATENT DOCUMENTS

| | | | |
|---|---|---|---|
| 90229 | 10/1983 | European Pat. Off. | 126/350 R |
| 52154 | 3/1984 | Japan | 126/350 R |

*Primary Examiner*—James C. Yeung

*Attorney, Agent, or Firm*—Andrus, Sceales, Starke & Sawall

[57] ABSTRACT

In a water heater (10), an access door (50) is provided covering dual openings (18, 44). The outer cylindrical jacket (14) of the water heater has an access opening (18). A power vent enclosure (34) extends outwardly and forwardly from the jacket and covers a portion of the access oopening (18). The power vent enclosure (34) has a sidewall (42) extending outwardly and forwardly from the jacket (14). The sidewall (42) has an opening (44) therethrough extending outwardly and forwardly from the jacket (14) at the access opening (18). The access door (50) covers both the sidewall opening (44) and the remainder of the access opening (18) not covered by the power vent enclosure (34).

22 Claims, 2 Drawing Sheets

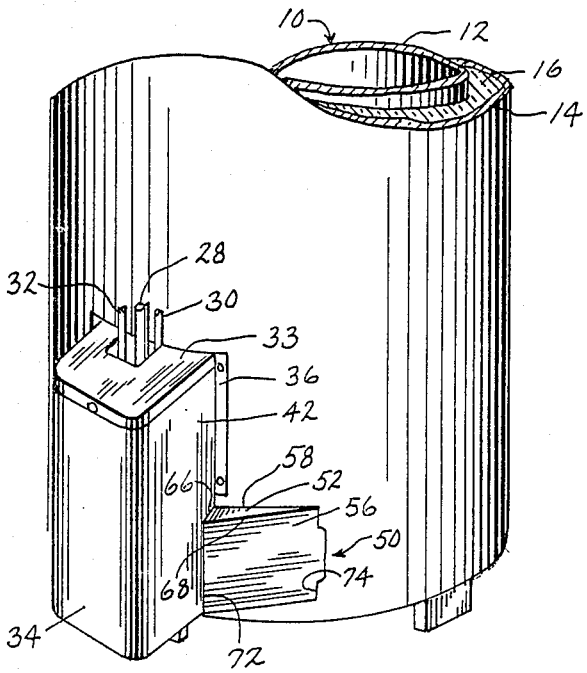
FIG. 5
FIG. 6
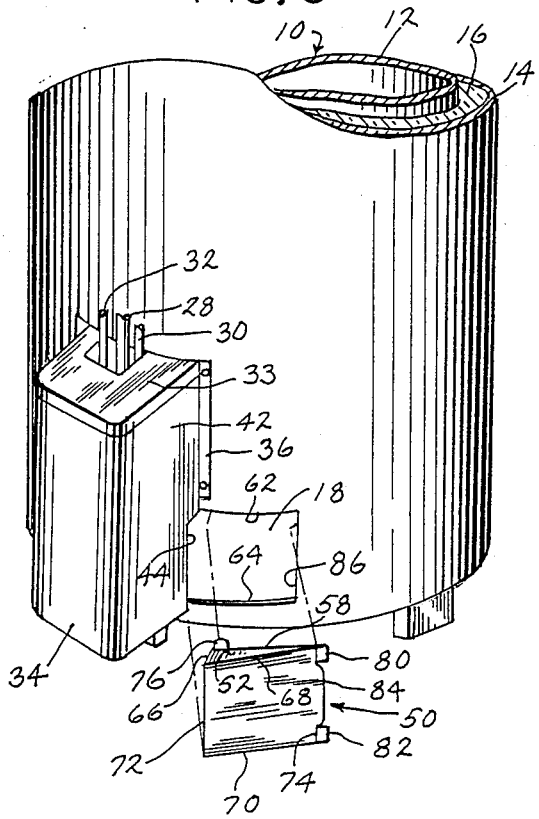
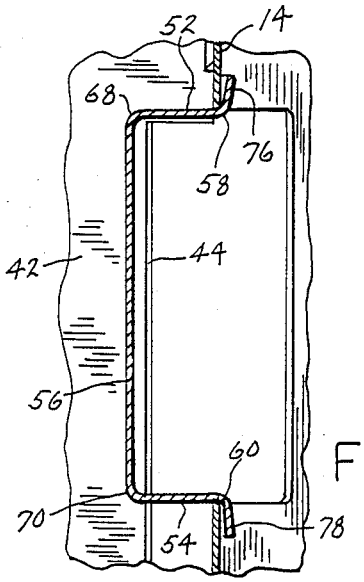
FIG. 8
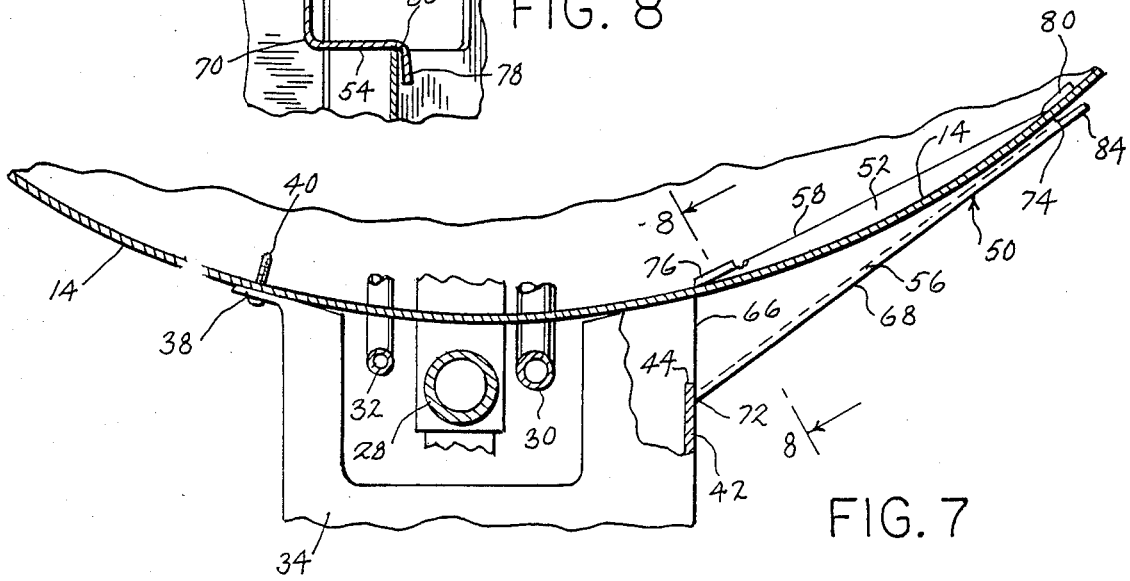
FIG. 7

WATER HEATER WITH POWER VENT ACCESS DOOR

BACKGROUND AND SUMMARY

The invention relates to water heaters, and more particularly to an access door therefore.

Water heaters include an inner storage tank to contain water to be heated, and an outer cylindrical jacket or casing spaced outwardly of the tank. Located within the annular space between the tank and the jacket is a layer of insulating material, typically fiberglass or foamed resin. In a conventional gasfired water heater, the water is heated by a burner located in a compartment beneath the tank. The lower end of the outer jacket is provided with an access opening in order to inspect and maintain the burner and pilot light or ignition device. The access opening is customarily enclosed by a sheet metal panel or door, secured to the jacket by tabs that engage slots in the jacket, as shown in FIGS. 1–4 herein, and described in further detail below. A corner of the panel is cut out to permit entry of the lines leading to the burner, pilot light and thermocouple. Another access door is shown in Ruark U.S. Pat. No. 4,777,933, incorporated herein by reference.

Some water heaters have a power vent for supplying combustion air to and/or exhausting spent combustion products from the burner. The power vent enclosure extends outwardly and forwardly from the jacket and covers a portion of the access opening. The power vent enclosure has a sidewall extending radially outwardly and forwardly from the jacket. The sidewall has an opening therethrough extending radially outwardly and forwardly from the jacket at the access opening. The above noted access door covers the access opening in the jacket, but not the sidewall opening in the power vent enclosure.

The present invention provides an access door covering both the sidewall opening in the power vent enclosure and the remainder of the access opening in the jacket which is not covered by the power vent enclosure. The present access door is particularly simple and cost effective in manufacture, and is forgiving of manufacturing tolerances in fitting to the access opening and sidewall opening. The latter feature is particularly desirable because neither the cylindrical jacket nor the power vent enclosure have a close manufacturing tolerance.

The access door's latching mechanism is also forgiving of manufacturing tolerance, and is particularly simple and efficient. In the preferred embodiment, the access door has top and bottom rearwardly extending walls which are gripped and deflected towards each other to allow clearance of tabs through the access opening in the jacket, whereafter the walls are released and the tabs engage the inner surface of the jacket to hold the door in place. The door has a front wall which is tapered at an angle and extends between the forwardly extending sidewall of the power vent enclosure and the jacket. The front wall of the door has one side engaging the sidewall of the power vent enclosure forwardly of the sidewall opening, and has its distally opposite side engaging the jacket at the other side of the access opening. The sidewall of the power vent enclosure and the jacket act as a stop against the diagonally extending front wall of the access door therebetween, to prevent the door from entering the jacket chamber upon impact.

BRIEF DESCRIPTION OF THE DRAWINGS

Prior Art

Present Invention

FIG. 5 is a view of a portion of a water heater incorporating the access door construction in accordance with the invention.

FIG. 6 is a view like FIG. 5, but with the access door spaced away from the access opening.

FIG. 7 is a sectional view from above of a portion of FIG. 5.

FIG. 8 is a sectional view taken along line 8—8 of FIG. 7.

DETAILED DESCRIPTION

Prior Art

Figure 1:
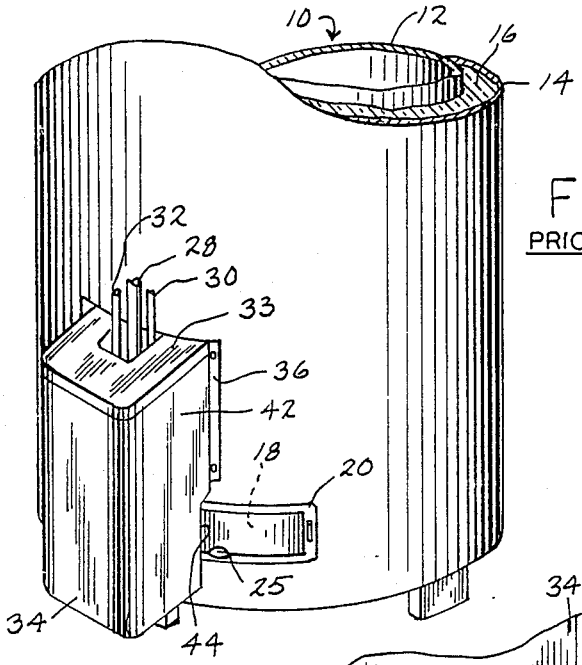
FIG. 1 PRIOR ART
FIG. 1 shows a portion of a water heater known in the prior art incorporating a power vent enclosure and an access door.
Figure 4:
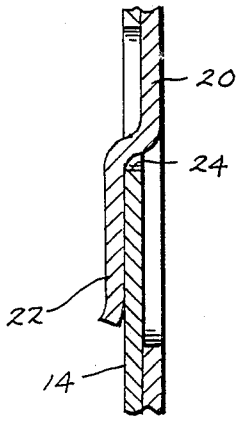
FIG. 4 PRIOR ART
FIG. 4 is a sectional view taken along line 4—4 of FIG. 3.
Figure 2:
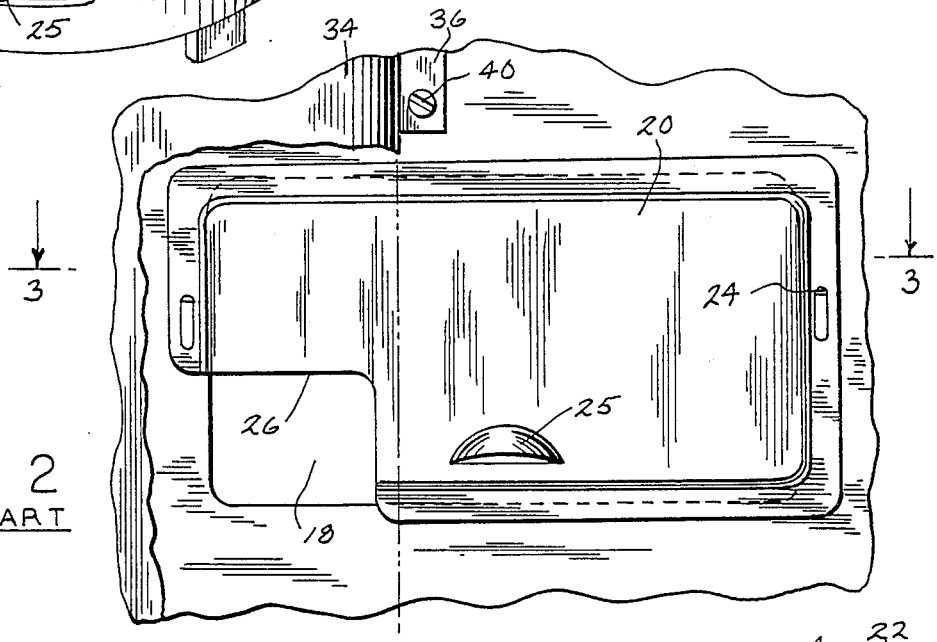
FIG. 2 PRIOR ART
FIG. 2 is a front elevation view of the access door of FIG. 1, with the power vent enclosure partially cut away.

FIG. 1 shows the lower portion of a conventional gas-fired water heater 10 including a cylindrical inner storage tank 12 to contain water to be heated, an outer cylindrical sheet metal jacket 14 spaced outwardly of tank 12, and a layer of insulation 16, such as fiberglass or foamed resin, in the annular space between inner tank 12 and outer jacket 14. A gas burner (not shown) is located beneath the lower end of tank 12 and acts to heat the water within the tank. To provide access to the burner and its components, the lower portion of jacket 14 has an access opening 18 formed therethrough, which is closed by a door 20. Door 20 is a sheet metal panel secured to jacket 14 by tabs 22 in slots 24 in the jacket, FIG. 4. The panel has a forwardly punched portion at 25 providing a thumb grip or the like, to facilitate upward sliding of the door for removal after clearing tabs 22 past slots 24. A corner of panel 20 is cut out as shown at 26, FIG. 2, to permit entry of gas line 28, pilot line 30, and thermocouple line 32 extending from the burner radially outwardly through access opening 18 in jacket 14 and then vertically upwardly parallel to the jacket. Lines 28, 30 and 32 are connected to a gas valve assembly as shown at 10 in incorporated Ruark U.S. Pat. No. 4,777,933. The gas valve assembly is usually spaced immediately above top cap 33 of power vent enclosure 34.

Figure 3:
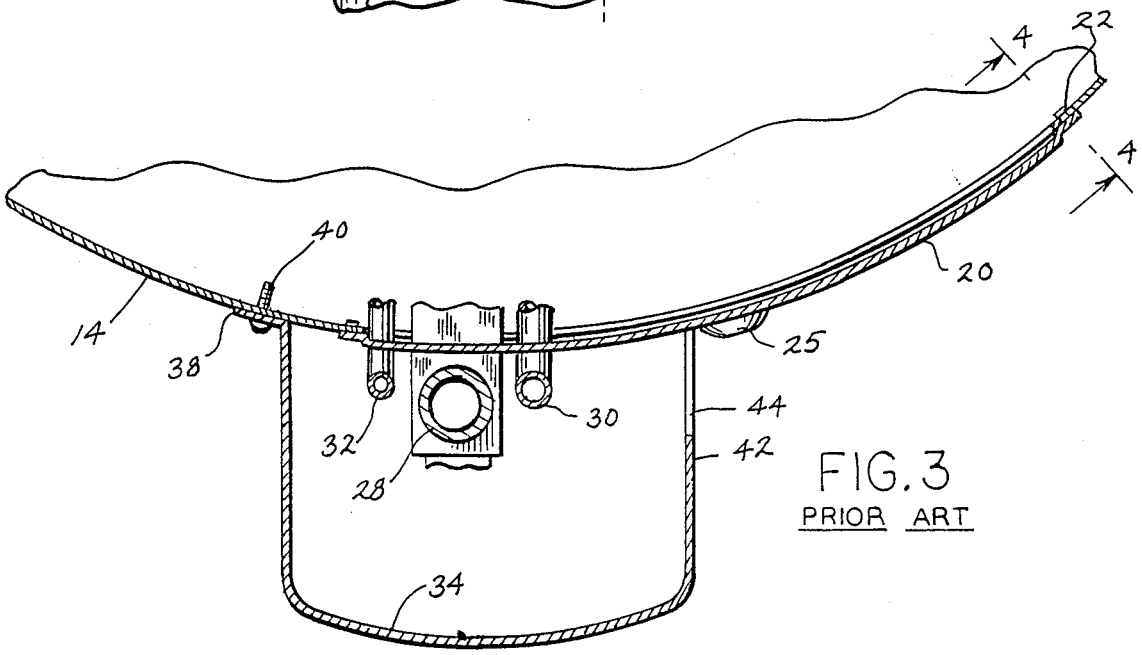
FIG. 3 PRIOR ART
FIG. 3 is a sectional view taken along line 3—3 of FIG. 2.

Power vent enclosure 34 extends outwardly and forwardly from jacket 14 and covers the left portion of access opening 18. Power vent enclosure 34 has side flanges 36 and 38 secured to jacket 14 by sheet metal screws such as 40, FIG. 3. Power vent enclosure 34 has a sidewall 42 extending radially outwardly and forwardly from jacket 14. Sidewall 42 has an opening 44 therethrough, FIGS. 1 and 3, extending radially outwardly and forwardly from jacket 14 at access opening 18. As seen in FIG. 3, access door 20 covers access opening 18 of jacket 14, but not sidewall opening 44 of power vent enclosure 34.

Present Invention

FIGS. 5–8 illustrate the present invention, and use like reference numerals from FIGS. 1-4 where appropriate to facilitate understanding. In accordance with the present invention, an access door 50 is provided which is mounted to the water heater and covers both sidewall opening 44 of power vent enclosure 34 and the remainder of access opening 18 of jacket 14 not covered by power vent enclosure 34. Access door 50 has top and bottom walls 52 and 54, FIGS. 5 and 8, each engaging jacket 14 adjacent access opening 18 and extending forwardly generally along power vent enclosure 34, adjacent sidewall opening 44. Access door 50 has a front wall 56 extending between top and bottom walls 52 and 54 and over access opening 18 and sidewall opening 44.

Each of top and bottom walls 52 and 54 of access door 50 extends rearwardly through access opening 18 to a respective substantially rectilinear rear edge 58 and 60 spaced inwardly of jacket 14, FIG. 7. Top wall 52 of access door 50 has a top surface engaging jacket 14 at the edge 62 thereof, FIG. 6, defining the top of access opening 18. Bottom wall 54 of access door 50 has a bottom surface engaging jacket 14 at the edge 64 thereof defining the bottom of access opening 18. The left side edge 66 of top wall 52 extends forwardly along and engages sidewall 42 of power vent enclosure 34 adjacent and above sidewall opening 44. The left side edge of bottom wall 54 of access door 50 extends forwardly along sidewall opening 44 and at its forward end engages sidewall 42 of power vent enclosure 34.

Top wall 52 of access door 50 is generally horizontal and triangularly shaped. As noted above, rear edge 58 of top wall 52 extends generally along jacket 14 adjacent access opening 18, and left side edge 66 extends forwardly from rear edge 58 generally along power vent enclosure 34 adjacent sidewall opening 44. Top wall 52 of access door 50 has a front diagonal edge 68. Bottom wall 54 of access door 50 has a front diagonal edge 70. Front wall 56 of access door 50 extends generally vertically between front diagonal edges 68 and 70 of top and bottom walls 52 and 54. Front wall 56 has distally opposite side edges 72 and 74. Left side edge 72 is adjacent and abuts sidewall 42 of power vent enclosure 34. Right side edge 74 is adjacent jacket 14. Front wall 56 is substantially planar and extends at an angle between sidewall 42 of power vent enclosure 34 and jacket 14 such that the front to rear gap between front wall 56 and access opening 18 is largest at the left edge 72 of front wall 56, and is smallest at the right edge 74 of front wall 56. Rear edge 58 and side edge 66 form an obtuse angle at their junction. Side edge 66 and front edge 68 form an acute angle at their junction. Front edge 68 and rear edge 58 form an acute angle at their junction which is smaller than the angle between edges 66 and 68. Bottom wall 54 of access door 50 is comparable to top wall 52.

Access door 50 has a plurality of tabs extending therefrom and engaging inner surfaces of the water heater to mount the door thereto. Tab 76, FIGS. 6-8, extends upwardly from top wall 52 of access door 50 at the left side of rear edge 58 adjacent sidewall opening 44 of power vent enclosure 34. Tab 76 engages the inner surface of jacket 14 above access opening 18. Tab 78, FIG. 8, extends downwardly from bottom wall 54 of access door 50 at the left side of rear edge 60 adjacent sidewall opening 44 of power vent enclosure 34. Tab 78 engages the inner surface of jacket 14 below access opening 18. Top and bottom walls 52 and 54 of access door 50 are grippable and deflectable toward each other to allow clearance of tabs 76 and 78 through access opening 18, to facilitate installation and removal.

Tabs 80 and 82, FIG. 6, extend rightwardly from the right side 74 of access door 50 and engage the inner surface of jacket 14 to the right of access opening 18. An additional tab 84 extends rightwardly from right side 74 over the outer surface of jacket 14 to the right of access opening 18. Tab 84 is a rightward extension of front wall 56 of access door 50, FIG. 7. To install door 50, right side 74 is inserted against the edge 86 of jacket 14 forming the right side of access opening 18, with tabs 80 and 82 rearward and within jacket 14, and tab or front wall extension 84 outside of and forward of jacket 14. The left sides of top and bottom walls 52 and 54 are then gripped and squeezed to deflect same towards each other and enable installation of the left side of the door in a pivoting-like movement clockwise, FIG. 7, about right end 74. These steps are reversed for removal of door 50.

During the noted pivoting-like clockwise movement of the access door in FIG. 7, left edge 72 of front wall 56 is stopped against sidewall 42 of power vent enclosure 34 to prevent further clockwise movement. The stop provided by sidewall 42 against left edge 72, and the stop provided by jacket 14 against right tab or front wall extension 84, prevent access door 50 from entering the jacket chamber upon impact.

It is recognized that various equivalents, alternatives and modifications are possible within the scope of the appended claims.

I claim:

1. A water heater comprising an inner storage tank, an outer cylindrical jacket spaced outwardly of said tank, an access opening through a lower portion of said jacket, a power vent enclosure extending outwardly and forwardly from said jacket and covering a portion of said access opening, said power vent enclosure having a sidewall extending radially outwardly and forwardly from said jacket, said sidewall having an opening therethrough extending radially outwardly and forwardly from said jacket at said access opening, an access door mounted to said water heater and covering both said sidewall opening and the remainder of said access opening not covered by said power vent enclosure.

2. The invention according to claim 1 wherein said access door is mounted to said jacket.

3. The invention according to claim 1 wherein said access door has top and bottom walls each engaging said jacket adjacent said access opening and extending forwardly therefrom generally along said power vent enclosure adjacent said sidewall opening, and wherein said access door has a front wall extending between said top and bottom walls and over said access opening and said sidewall opening.

4. The invention according to claim 3 wherein each of said top and bottom walls extends through said access opening to a rear edge spaced inwardly of said jacket.

5. The invention according to claim 4 wherein each of said rear edges is substantially rectilinear.

6. The invention according to claim 4 wherein said top wall has a top surface engaging said jacket at the edge thereof defining the top of said access opening, and wherein said bottom wall has a bottom surface engaging said jacket at the edge thereof defining the bottom of said access opening.

7. The invention according to claim 4 wherein each of said top and bottom walls has a side edge engaging said sidewall of said power vent enclosure adjacent said sidewall opening.

8. The invention according to claim 4 wherein said front wall extends at an angle along a diagonal between said sidewall of said power vent enclosure and said jacket, which diagonal extension of said front wall prevents said access door from entering said jacket upon impact.

9. The invention according to claim 8 wherein said front wall of said access door has one side engaging said sidewall of said power vent enclosure forwardly of said sidewall opening, and has another distally opposite side engaging said jacket adjacent said access opening.

10. A water heater comprising an inner storage tank, and outer cylindrical jacket spaced outwardly of said tank, an access opening through a lower portion of said jacket, a power vent enclosure extending outwardly and forwardly from said jacket and covering a portion of said access opening, said power vent enclosure having a sidewall extending radially outwardly and forwardly from said jacket, said sidewall having an opening therethrough extending radially outwardly and forwardly from said jacket at said access opening, an access door having top and bottom generally horizontal triangular shaped walls, each wall having a rear edge extending generally along said jacket adjacent said access opening, a side edge extending forwardly from said rear edge generally along said power vent enclosure adjacent said sidewall opening, and a front diagonal edge, said access door having a generally vertical front wall extending between said front diagonal edges of said top and bottom walls and covering said sidewall opening and the remainder of said access opening not covered by said power vent enclosure.

11. The invention according to claim 10 wherein said front wall has distally opposite side edges, one side edge being adjacent said sidewall of said power vent enclosure and forward of said sidewall opening, the other side edge being adjacent said jacket.

12. The invention according to claim 11 wherein said front wall of said access door is substantially planar and extends at an angle between said sidewall of said power vent enclosure and said jacket such that the front to rear gap between said front wall and said access opening is largest at said one edge of said front wall, and is smallest at said other edge of said front wall.

13. The invention according to claim 12 wherein said rear edge and said side edge of each of said top and bottom walls of said access door form an obtuse angle at their junction, said side edge and said front edge of each of said top and bottom walls form an acute angle at their junction, said front edge and said rear edge of each of said top and bottom walls form an acute angle at their junction which is smaller than said first mentioned acute angle.

14. A water heater comprising an inner storage tank, an outer cylindrical jacket spaced outwardly of said tank, an access opening through a lower portion of said jacket, a power vent enclosure extending outwardly and forwardly from said jacket and covering a portion of said access opening, said power vent enclosure having a sidewall extending radially outwardly and forwardly from said jacket, said sidewall having an opening therethrough extending radially outwardly and forwardly from said jacket at said access opening, an access door having top and bottom walls each engaging said jacket adjacent said access opening and extending forwardly therefrom generally along said power vent enclosure adjacent said sidewall opening, said access door having a front wall extending between said top and bottom walls and over said sidewall opening and the remainder of said access opening not covered by said power vent enclosure, a plurality of tabs extending from said access door and engaging the inner surface of at least one of said jacket and said power vent enclosure.

15. The invention according to claim 14 comprising a first said tab extending upwardly from said top wall of said access door, and a second said tab extending downwardly from said bottom wall of said access door, said top and bottom walls being deflectable toward each other to allow clearance of said first and second tabs through said access opening, to facilitate installation and removal.

16. The invention according to claim 15 wherein each of said top and bottom walls extends through said access opening to a rear edge inward of said jacket, and wherein said first tab is at said rear edge of said top wall and is adjacent said sidewall opening in said power vent enclosure, and wherein said second tab is at said rear edge of said bottom wall and is adjacent said sidewall opening in said power vent enclosure.

17. The invention according to claim 14 wherein said access door has distally opposite sides, one side being adjacent said sidewall of said power vent enclosure and forward of said sidewall opening, the other side being adjacent said jacket, and wherein said tabs comprise one or more side tabs extending from said other side of said access door and engaging the inner surface of said jacket.

18. The invention according to claim 17 comprising at least one additional tab extending from said other side of said access door outside of said jacket and forward of the outer surface of said jacket.

19. The invention according to claim 14 wherein said front wall extends at an angle along a diagonal between said sidewall of said power vent enclosure and said jacket, which diagonal extension of said front wall prevents said access door from entering said jacket upon impact.

20. The invention according to claim 19 wherein said front wall of said access door has one side engaging said sidewall of said power vent enclosure forwardly of said sidewall opening, and has another distally opposite side engaging said jacket adjacent said access opening.

21. The invention according to claim 14 wherein said front wall of said access door extends at an angle between said power vent enclosure and said jacket and has distally opposite side edges, one side edge being adjacent said sidewall of said power vent enclosure and forward of said sidewall opening, the other side edge being adjacent said jacket, and wherein each of said top and bottom walls of said access door extends through said access opening to a rear edge inward of said jacket, and comprising a first said tab extending upwardly from said rear edge of said top wall of said access door adjacent said sidewall opening of said power vent enclosure, a second said tab extending downwardly from said rear edge of said bottom wall of said access door and adjacent said sidewall opening, and at least a third said tab extending sideways from said other side edge of said front wall of said access door and engaging the inner surface of said jacket.

22. A water heater comprising an inner storage tank, an outer cylindrical jacket spaced outwardly of said tank, an access opening through a lower portion of said jacket, a power vent enclosure extending outwardly and forwardly from said jacket and covering a portion of said access opening, said power vent enclosure having a sidewall extending radially outwardly and forwardly from said jacket, said sidewall having an opening therethrough extending radially outwardly and forwardly from said jacket at said access opening, an access door having top and bottom generally horizontal triangular shaped walls, each wall having a rear edge extending generally along said jacket adjacent said access opening, a side edge extending forwardly from said rear edge generally along said power vent enclosure adjacent said sidewall opening, and a front diagonal edge, said access door having a generally vertical front wall extending between said front diagonal edges of said top and bottom walls, said front wall having distally opposite side edges, one side edge of said front wall being adjacent said sidewall of said power vent enclosure and forward of said sidewall opening, the other side edge of said front wall being adjacent said jacket, said front wall extending at an angle between said sidewall of said power vent enclosure and said jacket such that the front to rear gap between said front wall and said access opening is largest at said one edge of said front wall and is smallest at said other edge of said front wall, a first tab extending upwardly from said rear edge of said top wall of said access door adjacent said sidewall opening of said power vent enclosure and engaging the inner surface of said jacket, a second tab extending downwardly from said rear edge of said bottom wall of said access door adjacent said sidewall opening of said power vent enclosure and engaging the inner surface of said jacket.

* * * * *